US005462033A

United States Patent [19]

Best

[11] Patent Number: 5,462,033

[45] Date of Patent: Oct. 31, 1995

[54] FUEL PUMPING APPARATUS

[75] Inventor: Christopher H. Best, Kent, England

[73] Assignee: Lucas Industries Public Limited Company, England

[21] Appl. No.: 256,911

[22] PCT Filed: Apr. 6, 1993

[86] PCT No.: PCT/GB93/00717

§ 371 Date: Aug. 2, 1994

§ 102(e) Date: Aug. 2, 1994

[87] PCT Pub. No.: WO93/21438

PCT Pub. Date: Oct. 28, 1993

[30] Foreign Application Priority Data

Apr. 9, 1992 [GB] United Kingdom ..... 9207851
Aug. 12, 1992 [GB] United Kingdom ..... 9217087

[51] Int. Cl.[6] ..... F07M 41/14

[52] U.S. Cl. ..... 123/502

[58] Field of Search ..... 123/379, 450, 123/462, 460, 500, 501, 502

[56] References Cited

U.S. PATENT DOCUMENTS

| | | | |
|---|---|---|---|
| 4,132,508 | 1/1979 | Mowbray | 417/462 |
| 4,334,514 | 6/1982 | Konrath et al. | 123/502 |
| 4,432,327 | 2/1984 | Salzgeber | 123/502 |
| 4,476,837 | 10/1984 | Salzgeber | 123/502 |
| 4,502,449 | 3/1985 | Laufer | 123/502 |
| 4,522,181 | 6/1985 | Greiner et al. | 123/502 |
| 4,594,989 | 6/1986 | Laufer | 123/502 |
| 4,932,385 | 6/1990 | Knurreck | 123/502 |
| 5,085,196 | 2/1992 | Hain | 123/502 |
| 5,125,802 | 6/1992 | Nakamura et al. | 123/502 |
| 5,138,999 | 8/1992 | Tomsett | 123/450 |
| 5,180,290 | 1/1993 | Green | 123/450 |

FOREIGN PATENT DOCUMENTS 2097484 11/1982 United Kingdom .

*Primary Examiner*—Thomas N. Moulis
*Attorney, Agent, or Firm*—Andrus, Sceales, Starke & Sawall

[57] ABSTRACT

A fuel pumping apparatus of the rotary distributor type has a pumping plunger (14) mounted in a bore (13) in the distributor member and a cam ring (24) operable to move the plunger inwardly in timed relationship with the associated engine. The cam ring is positioned by a fluid pressure operable piston (25) contained within a cylinder (26). The apparatus includes a further piston (31) mounted in a further cylinder connected to the first mentioned cylinder, the further piston being biased by a pre-stressed spring (32). A stop is provided to limit the movement of the further piston against the action of the spring which yields to limit the fuel pressure developed by the plunger during the initial inward movement.

4 Claims, 2 Drawing Sheets

FUEL PUMPING APPARATUS

Figure 1:
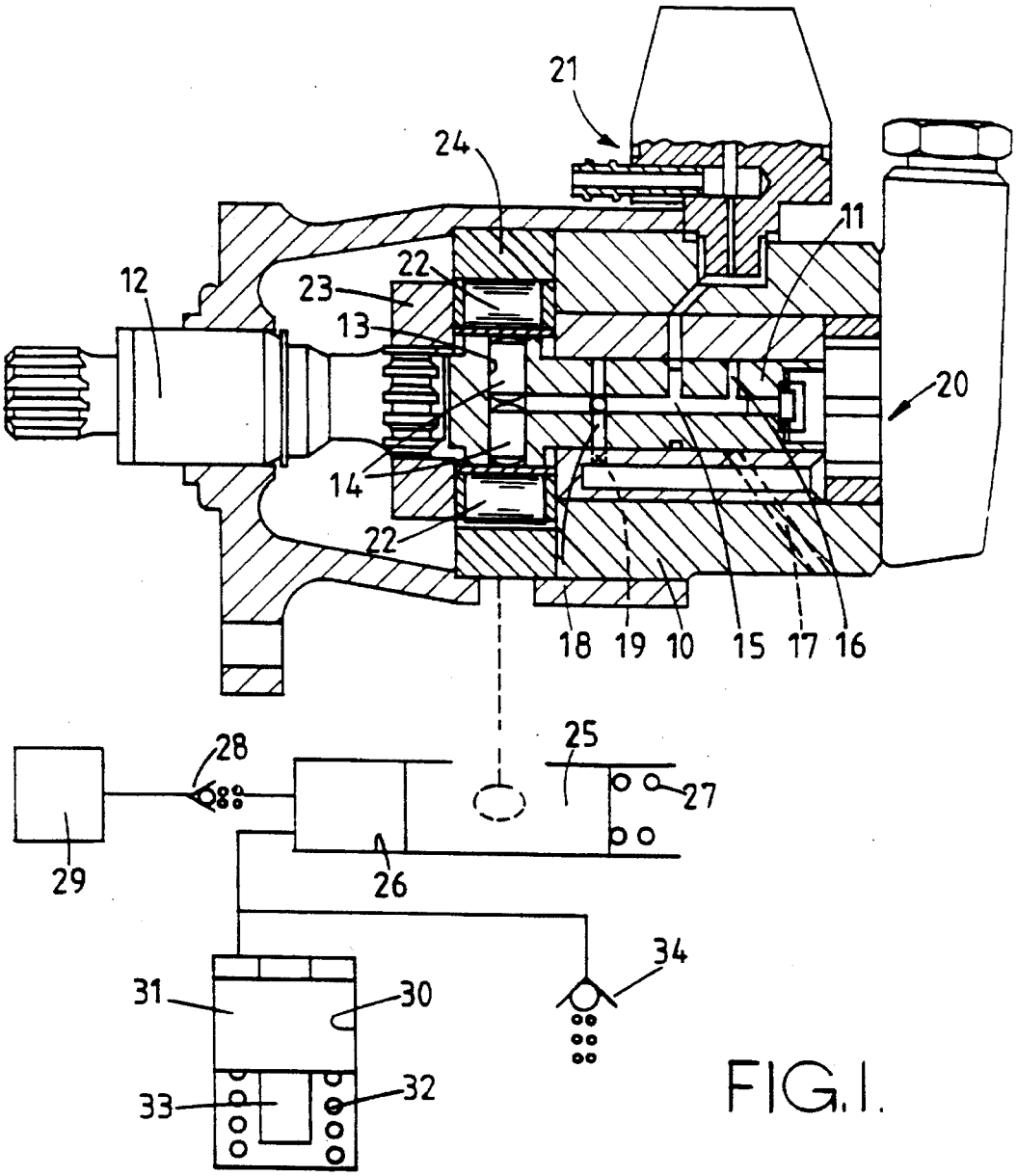

This invention relates no a fuel pumping apparatus for supplying fuel to a compression ignition engine and of the kind comprising a bore and a pumping plunger mounted in the bore, an outlet from the bore through which fuel can be displaced to an associated engine during inward movement of the plunger in the bore, cam means for imparting inward movement to the plunger, a drive shaft which is driven in synchronism with the engine and operable in conjunction with the cam means to impart inward movement to the plunger in timed relationship with the engine, fluid pressure operable means associated with the cam means for varying the commencement of inward movement of the plunger, means for varying the quantity of fuel supplied by the apparatus to the associated engine, the fluid pressure operable means comprising a timing piston contained within a timing cylinder, means coupling the timing piston to a part of the cam means, the timing piston being biased towards one end of the timing cylinder by resilient means, the fluid in said one end of the timing cylinder acting to oppose the movement of the timing piston when the plungers are moved inwardly by the cam lobes, and a further piston contained within a further cylinder one end of which is connected to said one end of the timing cylinder, and a pre-stressed spring urging the further piston towards said one end of the further cylinder, said further piston and said timing piston yielding to allow movement of the piston under the action of the cam reaction forces.

In a first example of such an apparatus the plunger or plungers is/are mounted in a transverse bore formed in a rotary distributor member which is mounted in a fixed body and which is coupled to the drive shaft so as to rotate therewith. The cam means comprises an annular cam ring which has cam lobes on its internal surface and these are engaged by followers associated with the plungers. The cam ring is angularly movable in the body or housing of the apparatus to vary the timing of fuel delivery and this is effected by a fluid pressure operable piston. The quantity of fuel supplied by the apparatus Is determined by a valve means operable to spill fuel at a high rate from the bore. The valve may be a servo operated valve controlled either mechanically or electrically. The bore is completely filled with fuel during the filling period of the apparatus.

In a second example of the apparatus the plunger or plungers is/are again mounted in a transverse bore formed in a distributor member but the amount of fuel which is supplied to the associated engine is controlled by restricting the amount of fuel which is supplied to the bore using for example, an adjustable throttle member. The pumping plunger or plungers in this form of apparatus deliver fuel to the associated engine throughout their full inward movement in particular, while the associated cam followers move over the crests of the cam lobes. An example of this form of apparatus is seen in U.S. Pat. No. 4,132,508.

In a third example of the apparatus the plunger as well as being axially movable in the bore by the action of the cam means, is also coupled to the drive shaft so as to rotate therewith. The plunger is therefore able to act as a distributor element to ensure that fuel is delivered to a plurality of outlets in turn. A portion of the plunger extends from the bore and is surrounded by a sleeve the axial portion of which can be varied to alter the position during inward movement of the plunger, at which fuel is spilled from the bore.

In U.S. Pat. No. 4,132,508 the further piston and the timing piston are movable throughout the whole of the period the pumping plunger is movable inwardly by the cam and the practical effect is that the fuel injection characteristic is modified throughout the full inward movement of the pumping plunger. The purpose of the arrangement is to avoid having to change the cam profile in order to change the injection characteristic.

It is recognised in the compression ignition engine art that there is a need to minimise the amount of fuel which is supplied to an engine in the so called ignition delay period which is the period between the start of fuel delivery and the commencement of combustion of the fuel. If too much fuel is delivered during this period very high pressures are generated in the combustion chambers of the engine when combustion of the fuel does take place and these high pressures lead to increased stress of the mechanical components of the engine and also to engine noise.

Various methods such for example as shaping the leading flanks of the cam lobes and the provision of restrictors and bypass valves are known for the purpose of restricting or controlling the fuel supply to the engine during the ignition delay period but these are of limited effect particularly where the apparatus is designed to supply fuel at high pressures at low engine speeds.

The second example of apparatus mentioned above suffers from the disadvantage that as the cam followers approach the crests of the cam lobes, the rate of inward movement of the plungers diminishes. This is because the crests of the cam lobes are rounded in order to reduce the stress in the materials forming the cam lobes and the followers. The effect is that the rate of flow of fuel to the engine diminishes and the resulting reduced pressure of fuel can lead to poor atomisation of the fuel. Moreover, the period of fuel delivery is extended as compared for example with the first example of apparatus and both the reduction of fuel pressure and the extension of the delivery period can cause problems with the fuel combustion process leading to smoke in the engine exhaust.

The object of the invention is to provide an apparatus of the kind specified in a simple and convenient form.

According to the invention the apparatus comprises stop means acting to limit the movement of the further piston against the action of the spring whereby for a given cam profile the quantity of fuel delivered through said outlet whilst the further piston is moving towards said stop means is reduced, said quantity of fuel being the initial portion of the total quantity of fuel delivered through the outlet.

Figure 2:
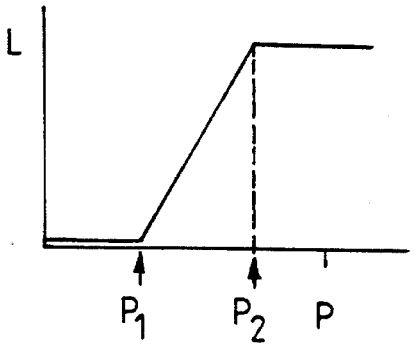
Figure 3:
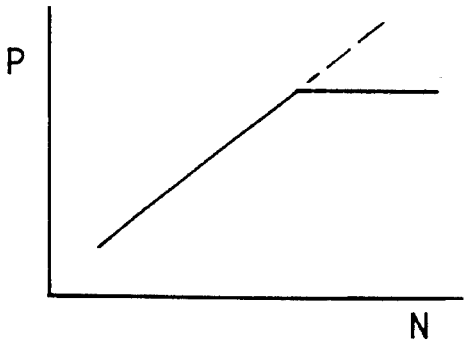
Figure 4:
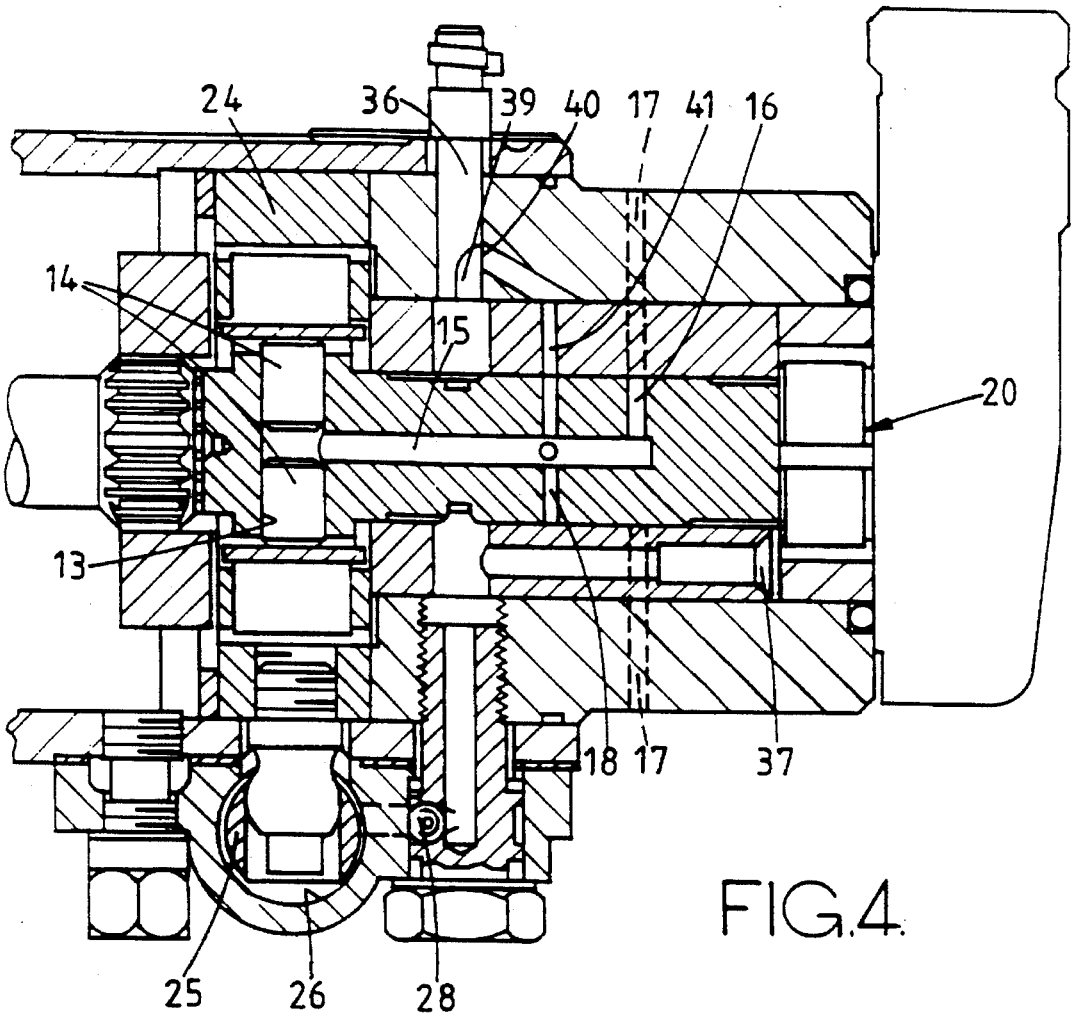

Examples of fuel pumping apparatus in accordance with the invention will now be described with reference to the accompanying drawings in which:

FIG. 1 is a part sectional side elevation of one example of the apparatus with the remaining portion of the apparatus being shown in diagrammatic form, FIGS. 2 and 3 are graphs demonstrating the operation of the apparatus shown in FIG. 1, and FIG. 4 shows a part sectional side elevation of another form of apparatus.

Referring to FIG. 1 of the drawings the apparatus comprises a body 10 in which is mounted a rotary cylindrical distributor member 11 which is connected to a drive shaft 12 arranged in use to be driven from the associated engine so that the distributor member rotates in timed relationship therewith. Formed in the distributor member is a transverse bore 13 in which is mounted a pair of pumping plungers 14. The bore 13 is in communication with a passage 15 extending within the distributor member and at one point the passage is in communication with a radially disposed delivery passage 16 which is arranged to register in turn and as the distributor member rotates, with a plurality of outlet ports 17 only one of which is shown. The outlet ports in use, are connected to the injection nozzles of the associated engine by means of individual pipelines.

At another point the passage 15 communicates with a plurality of radially disposed inlet passages 18 which register in turn with an inlet port 19 which is in communication with the outlet of a low pressure fuel supply pump generally indicated at 20. The outlet pressure of the fuel supply pump is controlled by valve means not shown, so that it varies in accordance with the speed at which the apparatus is driven. The passage 15 also communicates with a circumferential groove formed on the periphery of the distributor member and this groove is in constant communication with a spill valve indicated at 21, which is mounted in the body part 10. The spill valve in the example is electromagnetically operated and is controlled by an electronic control system (not shown). It is capable of spilling the fuel very quickly and in practice would be a servo operated spill valve the operation of which is controlled by an electromagnetically operable valve. The servo operated valve could however be controlled by a mechanical hydraulic valve.

At their outer ends the plungers are engaged by cam followers 22 respectively the cam followers conveniently being located within slots formed in an annular member 23 which is driven in synchronism with the distributor member. The cam followers include rollers which are positioned to engage with cam lobes formed on the internal peripheral surface of a cam ring 24 which is mounted in the body. The cam ring is movable angularly about the axis of rotation of the distributor member by means of a timing piston 25 which is slidably located in a timing cylinder 26. The piston 25 is biased by a spring 27 towards one end of the timing cylinder and the piston is movable in the opposite direction by fluid under pressure which is supplied to the one end of the timing cylinder by way of a non-return valve 28 from a control 29 which may be of an electromagnetic nature controlled by the control system. The cylinder 26 may be connected through the valve 28 to the outlet of the low pressure pump 20.

In operation, during inward movement of the plungers 14 under the action of the cam lobes, fuel can be expelled from the pumping chamber and will flow by way of the passages 15 and 16 to one of the outlets 17. The quantity of fuel which is supplied is determined by the spill valve 21 and when the valve is de-energised fuel can flow from the passage 15 to a drain instead of being supplied through the outlet. As the distributor member continues to rotate the delivery passage 16 will move out of register with an outlet 17 and one of the inlet passages 18 will move into register with the inlet port 19. Fuel will then be supplied to the bore 13 to move the pumping plungers 14 and the associated cam followers outwardly their maximum extent as permitted by the cam lobes. Further rotation of the distributor member will cause fuel to be supplied to the next outlet as the plungers are moved inwardly by the next set of cam lobes.

The commencement of fuel delivery to the associated engine can be varied by moving the timing piston 25 and this is achieved by controlling the fluid pressure in the one end of the timing cylinder 26. When the plungers are being moved inwardly by the cam lobes there is a reaction on the cam ring which is transmitted to the piston 25. The reaction tends to move the piston 25 towards the one end of the cylinder and the valve 28 closes to prevent appreciable fuel displacement from the cylinder except as will be described.

In order to limit the quantity of fuel which is supplied by the apparatus during the ignition delay period, a limited movement of the cam ring due to cam reaction, is allowed and this is achieved by connecting the one end of the timing cylinder 26 to one end of a further cylinder 30 which contains a further piston 31. The further piston is biased by a spring 32 towards the one end of the cylinder and the movement of the piston 31 away from the one end of the cylinder is limited by a stop member 33 which can engage the opposite end wall of the cylinder.

The spring 32 is a pre-stressed spring and the extent of pre-stress together with the spring rate are chosen so that sufficient angular movement of the cam ring takes place under the cam reaction during the initial period of supply of fuel to the associated engine. Effectively this means that the rate of fuel delivery is reduced and therefore a smaller quantity of fuel will be supplied to the engine during the ignition delay period. FIG. 2 shows the relationship between the lift L of the further piston 31 and the pressure P in the one end of the cylinder 30. It will be seen that the piston 31 starts to move at pressure P1 and its movement is completed at pressure P2. The pressure P1 may be set so that movement of the piston 31 starts to take place before the pressure of fuel supplied to the injection nozzles attains the nozzle opening pressure. The pressure P2 is set so that some movement of the piston takes place after the valve member in the particular nozzle to which fuel is being supplied has opened.

If required the allowed stroke of the piston 31 may be adjusted in accordance with the engine speed and this can be achieved by providing an adjustable abutment for the stop member 33. The position of the abutment may be determined by the outlet pressure of the low pressure pump 20 or it may be controlled electrically by the control system. As illustrated the timing piston 25 and the further piston 31 are mounted in separate cylinders. It is possible however for the further piston 31 to be mounted in the cylinder 26 so that the equivalent of a split piston is provided.

When the spill valve opens to terminate delivery of fuel, the pressure of fuel in the bore 13 falls and so also does the cam reaction force. The pumping plungers 14 continue to move inwardly and the fuel displaced by the plungers flows through the spill valve. Since due to the reduction in the cam reaction force the pressure in the timing cylinder 26 and the further cylinder 30 also falls, the piston 31 will move under the action of the spring 32 and in so doing will displace the timing piston 25. The cam ring 24 will therefore move in the opposite direction to the distributor member thereby increasing the rate at which fuel is displaced by the pumping plungers. It is therefore necessary that the spill valve 21 should be able to cope with the additional flow of fuel and still provide the rapid reduction of pressure required to obtain sharp termination of fuel delivery.

The apparatus shown in FIG. 4 is of the type in which the quantity of fuel supplied to the bore is controlled in order to determine the amount of fuel supplied to the associated engine. The reference numbers shown in FIG. 4 corresponds to those of FIG. 1 where possible. As will be seen from FIG. 4 the spill valve 21 is omitted and in its place as a means for controlling the fuel quantity delivered to the associated engine, is an angularly adjustable throttle member 36 mounted in a bore in the body of the apparatus. The inner end of the bore communicates with the outlet 37 of the low pressure pump 20.

A slot 39 is formed in the throttle member 36 and it communicates with the bore and has variable communication with a port 40 formed in the wall of the bore. The port 40 communicates with a further port 41 opening onto the periphery of the distributor member at a position to register with the inlet passages 18. The angular position of the throttle member is determined in practice by a speed responsive governor mechanism and the arrangement is such during the time when a passage 18 is in register with the port 41 fuel will flow into the bore containing the plungers, the quantity of fuel being determined by the angular setting of the throttle member.

With the arrangement as described it will be appreciated that the actual instant of fuel delivery to the associated engine depends upon the quantity of fuel which is supplied to the bore 13 by way of the throttle member 36. As more fuel is supplied to the bore the plungers will move further outwardly and therefore the associated cam followers will engage the leading flanks of the respective cam lobes earlier so that the timing of delivery of fuel will advance as the quantity of fuel which is supplied to the apparatus is increased. The termination of fuel flow occurs when the plungers have moved inwardly their maximum amount as determined by the crest of the cam lobes. As stated, the cam lobes are rounded to reduce the stress in the material forming the cam lobes and also the cam followers.

The fuel injection nozzles which are connected to the outlets 17 incorporate fuel pressure actuated valve members and it is usual for the trailing faces of the cam lobes to be provided with dwell portions so that as the cam followers move over the crests of the cam lobes limited outward movement of the plungers takes place until the cam followers move onto the dwell portions. This limited outward movement allows a controlled reduction in the pressure in the various passages of the apparatus and also the pipelines which connect the outlets to the nozzles. In addition, as the pressure reduces the valve members in the nozzles close. Whilst the cam followers are held by the dwell portions the delivery passage 16 moves out of register with the outlet 17 leaving a controlled residual pressure in the pipeline and also in the passages of the apparatus.

The initial displacement of the cam ring 24 which takes place when the cam followers first engage the cam lobes also has the additional benefit that the time required for the valve members in the injection nozzles to close is reduced. This is achieved by allowing the cam ring when the cam followers are moving towards and over the crests of the cam lobes, to move angularly in the opposite direction to the direction of rotation of the distribution member.

When the cam followers approach the crests of the cam lobes the delivery pressure starts to fall as the rate of inward movement of the plungers decreases. When the pressure has diminished sufficiently the spring 27 moves the piston 31 and this causes displacement of the piston 25 thereby moving the cam ring 24 against the direction of rotation of the distributor member. As a result the crests of the cam lobes and the subsequent cam dwell portions are reached more quickly with consequent increases in the velocity of the plungers during the final portion of their inward movement and the initial outward movement. Thus there is obtained a more rapid reduction of the injection pressure at the end of the injection period and a reduction in the quantity of fuel which is admitted to the engine cylinder at a reduced rate and pressure.

In order to satisfy exhaust emission regulations it is necessary to ensure that at least the bulk of the fuel is supplied to the engine at high pressure. The forms of apparatus described can be designed to achieve this even at low engine speeds. However, as the engine speed increases so also does the pressure and the various components of the apparatus and the remaining portions of high pressure fuel system such as the injection nozzles and the pipelines connecting the nozzles to the apparatus have to be built to withstand the high pressures developed when the engine is operating at maximum speed and load.

A control of the maximum pressure can be obtained by allowing the cam ring 24 to move in the direction of rotation of the distributor member 11 and for this purpose a high pressure relief valve 34 is provided which is connected to limit the pressure in the cylinder 26. As soon as the pressure attains a predetermined value which is representative of the pressure of fuel generated by the inward movement of the pumping plungers, the relief valve 34 opens to allow movement of the piston 25 towards the one end of the cylinder. The effect of this is to reduce the rate of fuel delivery to the associated engine but in particular to control the pressure which is generated by the plungers. FIG. 3 illustrates the variation of injection pressure and it clearly demonstrates the limitation of the injection pressure as the relief valve opens. The fuel which flows past the relief valve may be collected in an accumulator and returned to the cylinder through a further non-return valve.

I claim:

1. A fuel pumping apparatus for supplying fuel to a compression ignition engine comprising a bore (13) and a pumping plunger (14) mounted therein, an outlet (15) from the bore and through which fuel can be displaced to an associated engine during inward movement of the plunger in the bore, cam means (24) for imparting inward movement to the plunger in timed relationship with the associated engine, a piston (25) slidable within a cylinder (26), said piston being coupled to said cam means whereby movement of the piston with the cylinder will vary the timing of fuel delivery to the engine, a resilient means (27) biasing the piston towards one end of the cylinder, valve means (28) through which fluid under pressure can be supplied to said one end of the cylinder to vary the setting of said piston, a further piston (31) housed in a further cylinder (30), passage means connecting said one end of said further cylinder (30) with said cylinder (26), a pre-stressed spring (32) urging the further piston towards said one end of the further cylinder, said further piston being subjected to the fluid pressure in said one end of said first mentioned cylinder (26) and yielding to allow movement of the piston (25) under the action of the cam reaction forces, and stop means (33) acting to limit the movement of the further piston (31) against the action of the pre-stressed spring (32).

2. An apparatus according to claim 1 including passage means through which fluid can be supplied to said one end of said first mentioned cylinder (26) to adjust the setting of said cam means and in which said valve means is a non-return valve (28) in said passage means to prevent escape of fluid under pressure from said cam.

3. An apparatus according to claim 2 characterised by a relief valve (34) operable to limit the fluid pressure in said cylinders (26, 30) during inward movement of the plunger by said cam means (24).

4. An apparatus according to claim 2, characterised by means responsive to the speed of the associated engine for adjusting the setting of said stop means (33).

* * * * *

UNITED STATES PATENT AND TRADEMARK OFFICE

CERTIFICATE OF CORRECTION

PATENT NO. 5,462,033

DATED October 31, 1995

INVENTOR(S) Christopher H. Best

It is certified that error appears in the above-indentified patent and that said Letters Patent is hereby corrected as shown below:

Claim 2, column 6, line 54, after "from" insert --said cylinders (26,30) during inward movement of the plungers by--

Signed and Sealed this

Sixteenth Day of January, 1996

Bruce Lehman

*Attest:*

BRUCE LEHMAN

*Attesting Officer*

*Commissioner of Patents and Trademarks*